US007174595B2

(12) United States Patent
Chen

(10) Patent No.: US 7,174,595 B2
(45) Date of Patent: Feb. 13, 2007

(54) BATHING BRUSH

(76) Inventor: Ching-Chen Chen, No. 80-2, Wung-Yuann Rd., Pei-Dou County Chang-Hau Hsien (TW)

( * ) Notice: Subject to any disclaimer, the term of this patent is extended or adjusted under 35 U.S.C. 154(b) by 541 days.

(21) Appl. No.: 10/342,403

(22) Filed: Jan. 15, 2003

(65) Prior Publication Data

US 2004/0134006 A1 Jul. 15, 2004

(51) Int. Cl.
*A47K 7/02* (2006.01)

(52) U.S. Cl. ..... 15/110; 15/210.1; 15/229.13; 15/114; 15/118; 15/229.11; 15/244.1; 601/135; 601/137; D28/63

(58) Field of Classification Search ..... 15/110, 15/210.1, 209.1, 107, 229.13, 114, 118, 229.11, 15/244.1, 244.3, 244.4, 187, 188; 601/134–138; D28/63

See application file for complete search history.

(56) References Cited

U.S. PATENT DOCUMENTS 1,482,546 A * 2/1924 Curtis ..... 15/110
2,253,210 A * 8/1941 Psiharis ..... 601/139
2,893,029 A * 7/1959 Vosbikian et al. ..... 15/118
5,944,032 A * 8/1999 Masterson ..... 132/290
D414,295 S * 9/1999 Coleman ..... D28/7
6,092,258 A * 7/2000 Chen ..... 15/209.1
6,195,829 B1 3/2001 Chen
6,370,723 B1 * 4/2002 Chang ..... 15/110
6,453,503 B1 9/2002 Chen
6,510,577 B1 * 1/2003 Borcherds et al. ..... 15/118
6,748,620 B2 * 6/2004 Ching-Chen ..... 15/110
2002/0166189 A1 * 11/2002 Huang ..... 15/209.1

* cited by examiner

*Primary Examiner*—Gary K. Graham
(74) *Attorney, Agent, or Firm*—Lowe Hauptman & Berner, LLP

(57) ABSTRACT

A bathing brush comprises an elongated bar, an elastic net and a massaging device. The bar has a base portion at an end thereof, a securing portion at an edge of the base portion and a handle having an end thereof fixed with the base portion. The elastic net is pressed into twisty condition and is fastened on a top surface of the base portion the massaging device made of a flexible material and molded into a single element has a base member, a sidewall on an edge of the base member, a second securing portion on an interior side of the sidewall and a plurality of grains on an exterior side of the base member wherein the second securing portion is connected with the first securing portion for securing the massaging device on a side of the base portion of the bar which is opposite from the elastic net such that a chamber will be formed between the base portion of the bar and the massaging device.

1 Claim, 3 Drawing Sheets

BATHING BRUSH

BACKGROUND OF THE INVENTION

1. Field of the Invention

The present invention relates generally to a bathing tool, and more particularly to a bathing brush which is capable of massaging and cleaning.

2. Description of the Related Art

In prior art, a conventional bathing brush which has a handle for user to hold and an elastic net fixed on the handle to scrub skin is taught by U.S. Pat. No. 6,453,503. Another type of conventional bathing brush is taught by U.S. Pat. No. 6,159,829, which has a handle and a massage device on the handle. It seems obviously to combine the aforesaid inventions to get a single bathing brush with both functions of cleaning and massage. User will feel uncomfortable with the hard massage device, and most of all, the amount of the massage device only has two ball-like elements and the ball-like elements only have massaging function, they can not clean filth on the skin at the same time.

SUMMARY OF THE INVENTION

The primary objective of the present invention is to provide a bathing brush, which has an apparatus having both functions of massaging and cleaning.

The second objective of the present invention is to provide a bathing brush, which has suitable flexibility to make user feel more comfortable when uses it.

According to the objectives of the present invention, a bathing brush comprises an elongated bar having a base portion at an end thereof, a securing portion at an edge of the base portion and a handle having an end thereof fixed with the base portion. An elastic net is pressed into twisty condition and is fastened on a top surface of the base portion. A massaging device made of a suitable flexible material and molded into a single element has a second securing portion and a plurality of grains wherein the second securing portion is connected with the first securing portion for securing the massaging device on a side of the base portion of the bar which is opposite from the elastic net such that a chamber will be formed between the base portion of the bar and the massaging device.

DETAILED DESCRIPTION OF THE INVENTION

Figure 1:
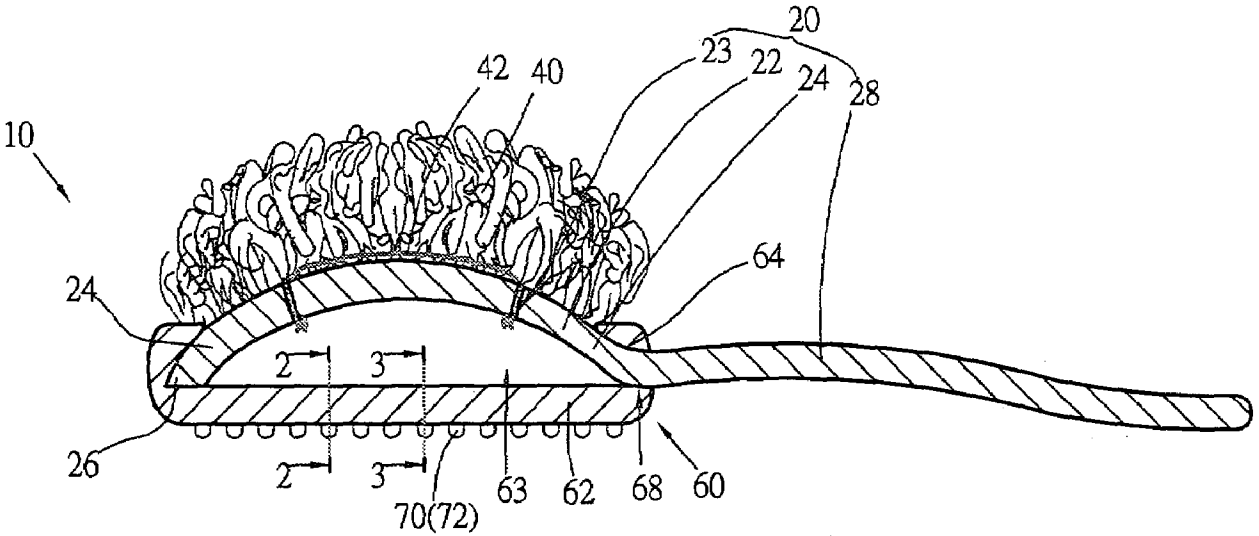
FIG. 1 is a sectional view of a first preferred embodiment of the present invention in an exploded condition.
Figure 2:
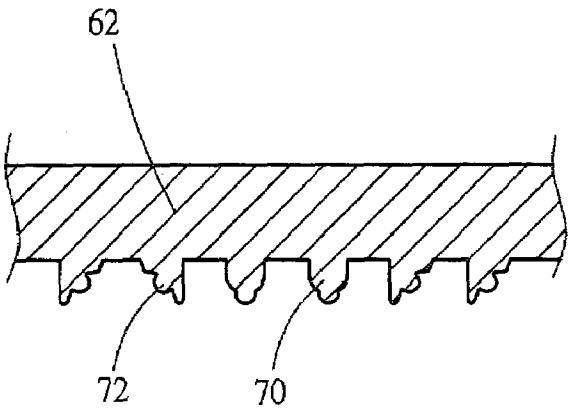
FIG. 2 is a sectional view along a 2—2 line in FIG. 1.
Figure 3:
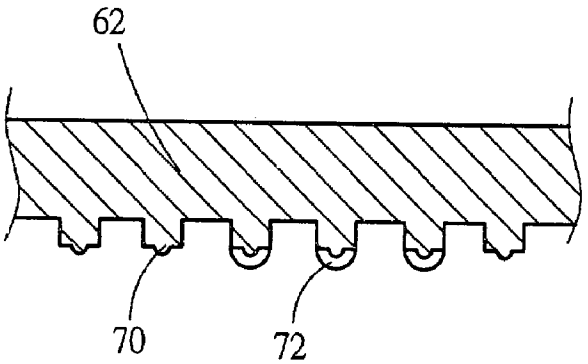
FIG. 3 is a sectional view along a 3—3 line in FIG. 2.

Please refer to FIGS. from FIG. 1 to FIG. 3, a bathing brush 10 of the preferred embodiment of the present invention mainly comprises an elongated bar 20, an elastic net 40 and a massaging member 60 mounted on an end of the bar 10.

The bar 10 has a base portion 22, a pair of holes 23 disposed on a bottom side of the base portion 22 in a suitable interval, a first sidewall 24 extended downward from an edge of the base portion 22, a first securing portion 26 formed at an exterior side of the first sidewall 24 and a handle 28 fixing an end thereof at an bottom end of the first sidewall 24.

The elastic net 20 having a suitable length is pressed into twisty condition and is fixed on a top side of the base portion 22 of the bar 20 via a fastening device 42, which is a cotton rope in the present embodiment, running through suitable portions of the elastic net 20 and the holes 23.

The massaging member 60 made from flexible or elastic material into a single disk-like element with suitable diameter has a base member 62, a second sidewall 64 extended upward from an edge of the base member 62, a second securing portion 66, which is an annular slot disposed on an interior side of the second sidewall 64 in the present embodiment, a through hole 68 having suitable width on the second sidewall 64 and running to said second securing portion 66 for passing the handle 28 through and a plurality of first grains 70 and second grains 72 on an exterior side of the base member 62. The massaging member 60 is mounted on the base portion 22 of the bar 20 with a chamber 63 formed in between the base portion 22 of the bar 20 and the base member 62 of the massaging member 60. Each of the first grains 70 has a proximal portion with larger diameter and a distal portion with smaller diameter on the proximal portion. Each of the second grains 72 is a round column with a gap thereon and a protruding portion of a sidewall of the gap.

With the bathing brush 10 of the present invention as described above, it can serve both functions of cleaning skin and massaging muscles, except that there further are four advantages when using it, which are:

1. The massaging device 60 is made of a well-elastic or well well-flexible material and the base member 62 having the first and the second grains 70 and 72 thereon to touch user's skin is suspended from the base portion 22 of the bar 20, which means there is the chamber 63 between the base portion 22 of the bar 20 and the base member 62 of the massaging member 60, so that the base member 62 of the massaging device 60 has a well flexibility to make user fell comfortable when using the brush 10.

2. The through hole 68 on the sidewall 64 will help the massaging device 60 not losing from the bar 20 when rubbing the massaging device 60 against user's skin.

3. User can push, rub or pat the first and the second grains 70 and 72 to user's skin so that can provide different result of massage.

4. The chamber 63 between the base portion 22 of the bar 20 and the base member 62 of the massaging member 60 can receives water therein to running slowly to the elastic net 40 via the holes 23 such that the elastic net 30 can clean user's skin in wet condition for seconds or minutes.

It is obvious to replace plastic rope or plastic band with the cotton rope to be the fastening device 42 to secure the elastic net 40 on the base portion 22 of the bar 20.

Figure 4:
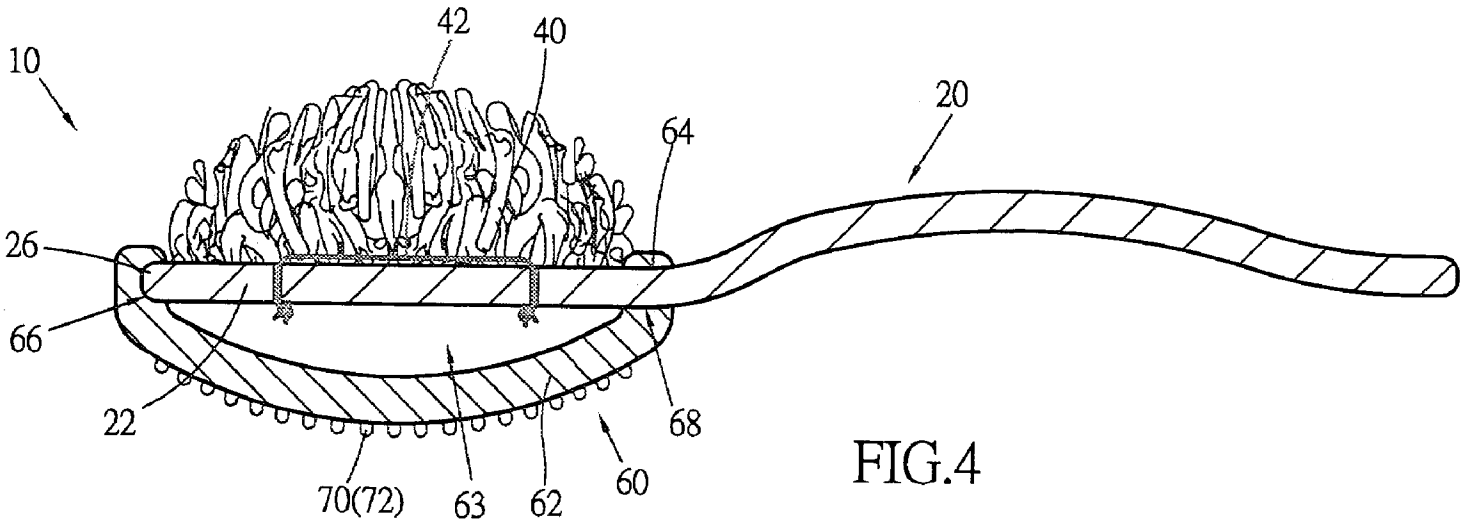
FIG. 4 is a sectional view of a second preferred embodiment of the present invention.

Please refer to FIG. 4, which shows a bathing brush of the second preferred embodiment of the present invention having a flat base portion 22 of a bar 20 and a convex base member 62 of a massaging device 60. The second preferred embodiment also provides a handle 28 on the base portion 22 distal from a first securing portion 26 such that said handle will not pass through a sidewall 64 of said massaging device 60, therefore, there is no need to provide a through hole on the sidewall 64.

Figure 5:
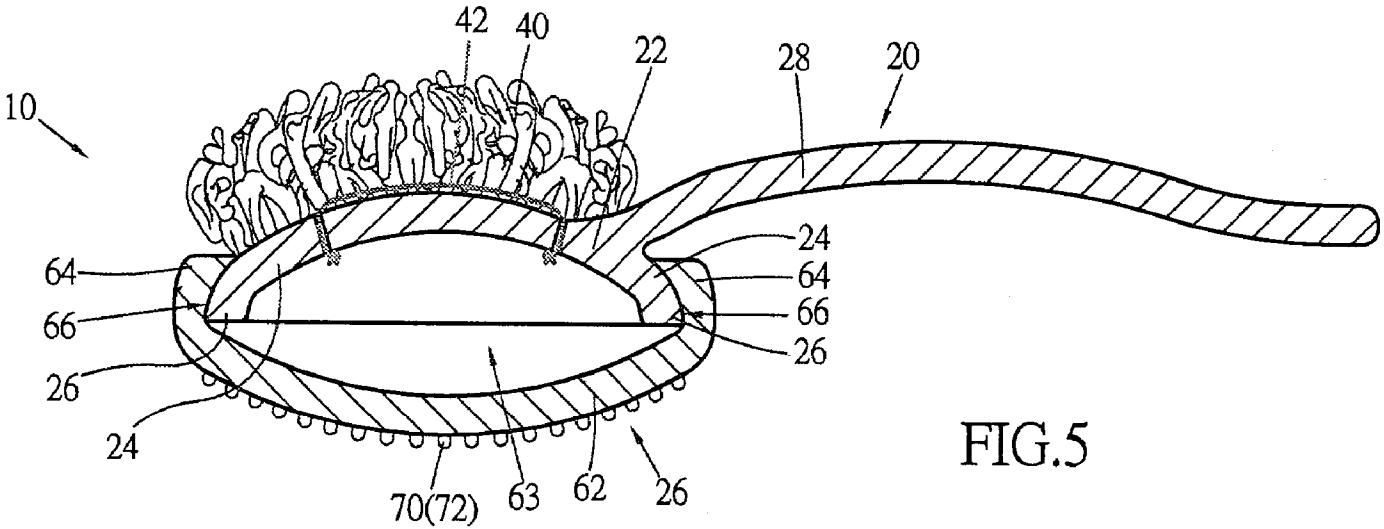
FIG. 5 is a sectional view of a third preferred embodiment of the present invention.

FIG. 5 shows a bathing brush of the third preferred embodiment of the present invention having a convex base portion 22 and a convex base member 62. In another words, both of the base portion 22 and the base member 62 have concave surfaces facing each other such that the size of a chamber 63 therebetween will be enlarged.

Figure 6:
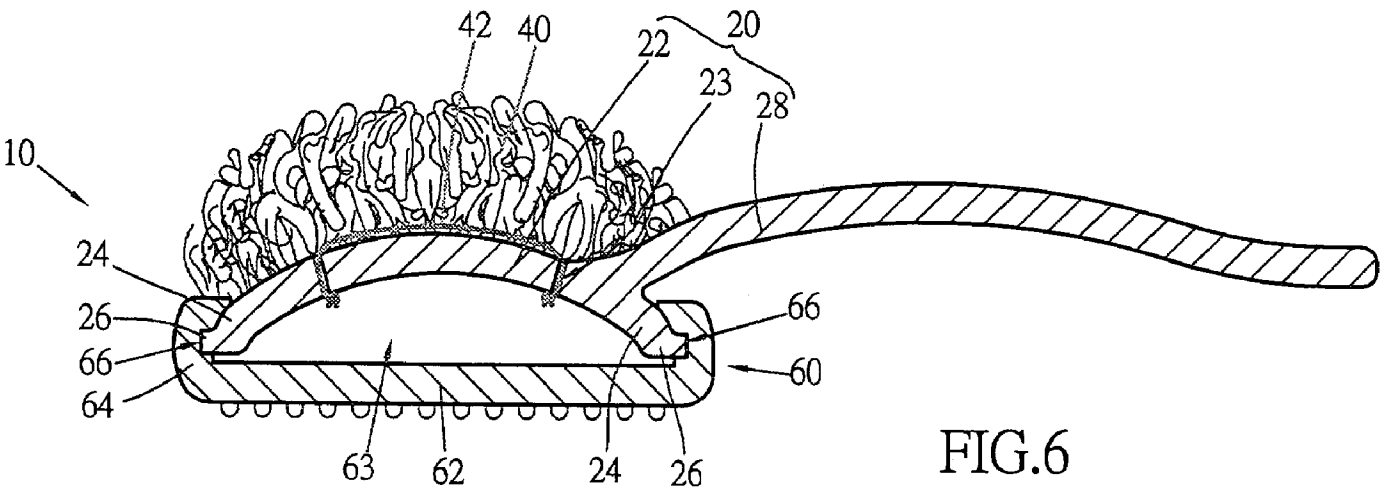
FIG. 6 is a sectional view of a fourth preferred embodiment of the present invention.

FIG. 6 shows a bathing brush of the fourth preferred embodiment of the present invention, which provides a second securing portion 66 on a sidewall 64 of a massaging device 60 at a position with a distance from a base member 62 so that an edge portion of the base member 62 will have flexibility when touching user's skin.

What is claimed is:

1. A bathing brush comprising:

an elongated bar having a base portion at an end thereof, a first securing portion at an edge of said base portion and a handle having an end thereof fixed with said base portion;

an elastic net having a predetermined length and pressed into twisty condition, wherein said elastic net is fastened on a top surface of said base portion;

a massaging device made of a suitable flexible material and molded into a single element having a second securing portion and a plurality of grains wherein said second securing portion is connected with said first securing portion for securing said massaging device on a side of said base portion of said bar which is opposite from said elastic net such that a chamber will be formed between said base portion of said bar and said massaging device; and wherein at least one of said grains is substantially a round column with a gap thereon and a protruding portion on a sidewall of said gap.

* * * * *